US006351926B1

(12) United States Patent
Hodge et al.

(10) Patent No.: US 6,351,926 B1
(45) Date of Patent: Mar. 5, 2002

(54) PACKAGING SYSTEM

(75) Inventors: Michael J. Hodge, Brunswick; Gregg H. Mertens, Parma Hts., both of OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 09/487,168

(22) Filed: Jan. 19, 2000

(51) Int. Cl.[7] ..... B65B 1/06
(52) U.S. Cl. ..... 53/473; 53/459
(58) Field of Search ..... 53/241, 250, 255, 53/257, 260, 262, 452, 457, 459, 469, 570, 571, 572, 573

(56) References Cited

U.S. PATENT DOCUMENTS

| | | | | |
|---|---|---|---|---|
| 3,014,321 A | | 12/1961 | Lesch | 53/195 |
| 3,699,741 A | | 10/1972 | Norman | 53/29 |
| 4,202,153 A | * | 5/1980 | Lerner et al. | 53/459 |
| 4,608,808 A | | 9/1986 | Ryan et al. | 53/436 |
| 4,864,800 A | | 9/1989 | Banys et al. | 53/428 |
| 5,987,854 A | * | 11/1999 | Killinger et al. | 53/459 |

OTHER PUBLICATIONS

C. M. Bishop. "Neural Networks for Pattern Recognition." *Bayes Theorem.* Clarendon Press. Oxford. Chap.1 pp. 17–23 (1995).

C.M. Bishop. "Neural Networks for Pattern Recognition." *The Normal Distribution* Clarendon Press.Oxford. Chap.2 pp. 34–38 (1995).

C.M. Bishop. "Neural Networks for Pattern Recognition." *Density Estimation in General.* Clarendon Press. Oxford pp.51–55 (1995).

C.M. Bishop. "Neural networks for Pattern Recognition." Mixtures Models/Maximum Likelihood/EM Algorithm. Clarendon Press. Oxford pp. 59–72 (1995).

* cited by examiner

*Primary Examiner*—Peter Vo
*Assistant Examiner*—Chukwurah Nathaniel
(74) *Attorney, Agent, or Firm*—Watts, Hoffman, Fisher & Heinke Co. LPA

(57) ABSTRACT

An improved loading assembly in a packaging system utilizing chains of interconnected preopened bags is disclosed. The assembly includes an elongated chute component including a tubular portion having spaced end loading and exit openings. The chute is movably mounted adjacent a load station for sequential cooperation with bags sequentially registered in and opened at the load station. A gate is mounted on the chute. The gate is movable between a closed position closing the exit opening and an open position for transfer of products being packaged from positions within the chute into registered bags. The gate includes a canning arrangement for moving the gate from its closed to its open position. A spring against the gate for urging the gate toward its closed position. A process of packaging using the assembly is also disclosed.

7 Claims, 3 Drawing Sheets

PACKAGING SYSTEM

This invention relates to packaging and more particularly to an assembly for facilitating the loading of products into bags which are then closed to form packages. The assembly is especially suited for use with a bagging machine of the type which utilizes chains of preopened and interconnected bags.

BACKGROUND OF THE INVENTION

The use of chains of preopened and interconnected bags, such as those described in U.S. Pat. No. 3,254,828 entitled "Flexible Container Strips" issued Jun. 7, 1966 to Hershey Lerner ("the AutoBag Patent"), have enjoyed wide commercial success. Automated Packaging Systems, Inc. ("Automated"), as the assignee of the AutoBag Patent, manufactures and sells bagging machinery especially suited to the formation of packages through the use of chains of bags of the type taught in the AutoBag Patent. A machine sold under the trademark Excel® is described and claimed in U.S. Pat. No. 5,394,676 issued Mar. 7, 1995 to Bernard Lerner et al. under the title "Packaging Machine and Method" ("the Excel Patent"). The Excel machine is capable of the highest cycle rates of any of the machines made by Automated for use with AutoBag® webs.

Typically, the Excel Machine is used as a component of a modular system. Such a system typically includes vibratory feeders which dispense measured quantities of products onto conveyors in synchronism with the cycling of an Excel Machine. Collections of products to be packaged are sequentially and one collection at a time deposited into open bags positioned in a load station of the Excel Machine.

While such modular systems are highly efficient for many products, long, thin products such as plastic eating utensils are not well suited for packaging in such a system. As a consequence, long and thin products have been hand loaded into open bags positioned at the load station of a bagger such as an Excel Machine. Accordingly, there is a need for a mechanism which facilitates the loading of long, thin products into open bags positioned at load stations.

SUMMARY OF THE INVENTION

The loading of long, thin products into bags is greatly facilitated by a bag loading assembly made in accordance with the present invention. The loading assembly of the present invention may, for example, be mounted on an Excel Machine. The assembly includes a reciprocatably mounted load chute. The chute has a through product retention and dispensing passage extending from a load to a discharge end. Upstream from the passage the chute includes a chute-like load area. A moveable gate normally closes the discharge end.

When products to be packaged are in a machine mounted chute, and an open bag is positioned at a load station of the machine, the chute is advanced into the bag opening, the gate is opened and the products in the chute are gravity fed into the bag. The chute is then returned to a load position as the gate is closed. An operator then loads the long, thin products for the next subsequent package onto the chute as the machine completes a cycle by (a) sealing the loaded bag, (b) separating it from the web, and (c) advancing the web to position the next and now end one of the chain of bags in the load station where it is opened.

Since loading of the chute is occurring as the machine cycles, production rates are greatly enhanced. They are enhanced because absent the novel loading mechanism of this invention, the machine must pause each time a newly opened bag is present in the load station for a time long enough for an operator to manually load the products directly into the bag.

The load assisting assembly of the present invention includes a base or frame that is mounted on a bagging machine. A chute support is reciprocally mounted on the base. An air cylinder is interposed between the support and the base to cause rapid reciprocation of the support relative to the base when products are to be discharged into a bag.

In the preferred and disclosed embodiment, a plurality of elongated chute and gate subassemblies are provided. The chutes are of differing dimensions in order that an operator may select a chute of a size appropriate for the products to be packaged and for the size of bags to be used in forming packages. Each such chute has a torsional spring return discharge gate for normally closing the discharge end.

In use an operator selects a chute and gate subassembly of a size appropriate for the products to be packaged and the bags to be used. The selected chute is removably mounted on a reciprocatable support. A cam arrangement is adjusted such that when the mounted chute is moved into registration with an open bag, its gate will be cammed opened and products contained within it will be discharged into the open bag. The chute and support are then retracted along their reciprocal path to a load position as the gate is biased into its closed position to block the discharge end of the chute.

In the preferred and disclosed embodiment, an air cylinder is interposed between the frame and the reciprocatable support to affect high speed movement from a chute load position to a discharge position and return. Dashpots are provided to arrest the motion into the load position as the gate is opened. With this arrangement, gravity feed of the products being packaged is enhanced by the inertia of motion of those products when the chute containing them is arrested into a quick and relatively sudden stop.

Accordingly, the objects of the invention are to provide a novel and improved mechanism for assisting in the formation of packages and a process of packaging.

THE PREFERRED EMBODIMENT

Figure 1:
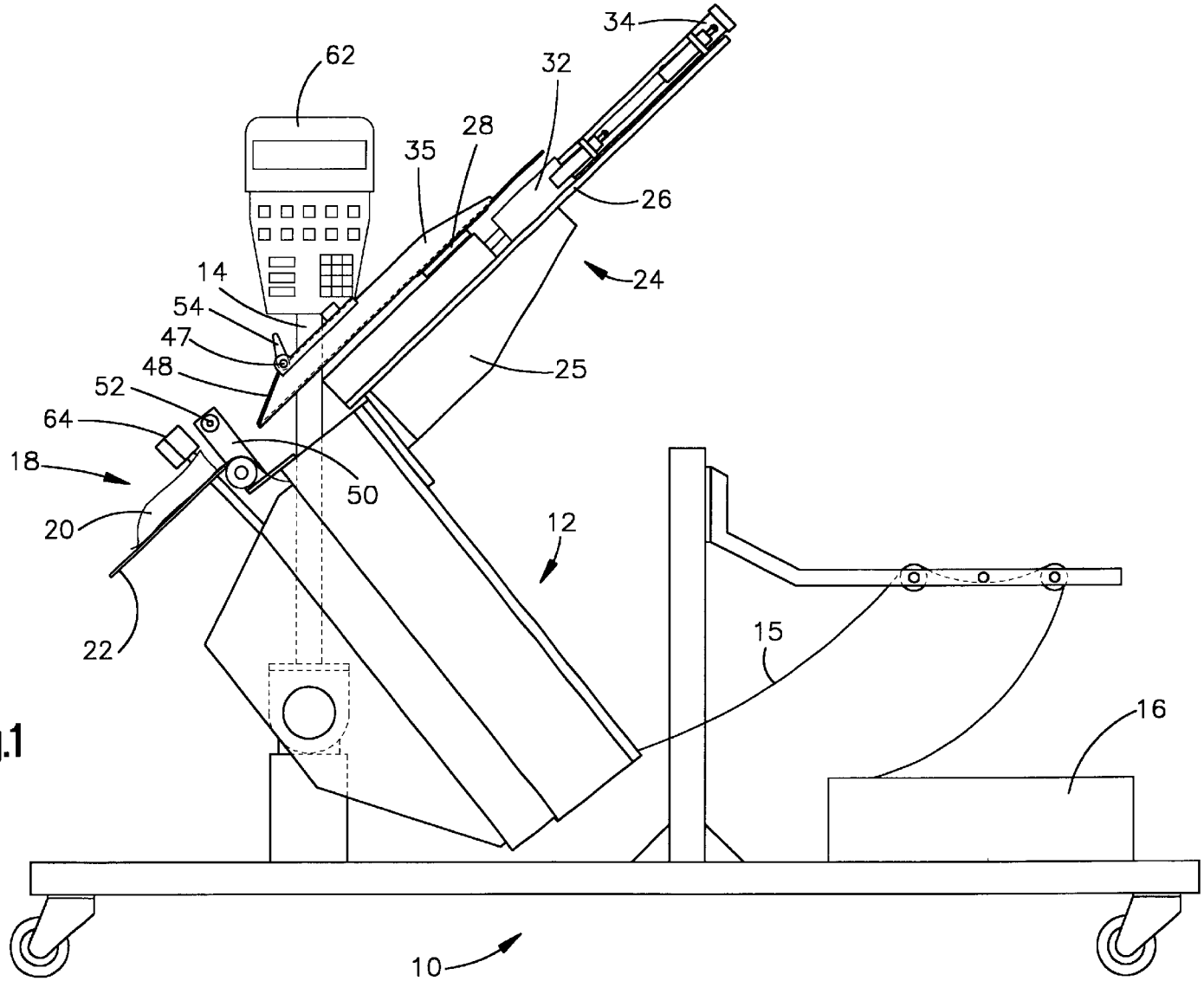
FIG. 1 is a side elevational view showing the loading system assembly of the present invention mounted on an Excel Machine.

Referring to the drawings and FIG. 1 in particular, a packaging system made in accordance to the present invention is shown generally at 10. The system 10 includes a bagger 12. The bagger 12 is rotatively mounted on a support post 14.

Aweb of bags 15 is fed from a bag supply 16. The pictured bag supply is of the type described and claimed in U.S. Pat. No. 4,201,029 issued May 6, 1980 under the title "Method and Apparatus for Packaging." The apparatus thus far described is a schematic showing of an Excel machine.

The load assembly of the present invention is shown generally at 24. The assembly 24 includes a mounting 25 for securing the assembly to the bagger 12. The mounting 25 is pictured in FIGS. 1 and 3.

The load assembly 24 includes a base 26 secured to the mounting 25. A chute support 28 is carried by a pair of reciprocatable rods 30. The rods 30 are reciprocatably mounted in a spaced pair of journaling blocks 32 fixed to the base 26. An air cylinder 34 is interposed between and operably connected to the base 26 and the chute support 28 to cause selective reciprocation of the chute support and the guide rods relative to the base 26.

A chute 35 is removably mounted on the chute support 28. The chute 35 is removably secured to the support 28 as by fastener 36. The chute 35 is removable in order that an operator may select a chute size appropriate for products being packaged and the size of the bags being loaded to produce packages.

The chute 35 has a flat bottom surface 38, upstanding sides 40 and a top 42. The base, sides and top 38,40,42 together define a through passage extending from an inlet at 44 to an outlet at 45. Products dropped into a trough-like load area 46 in a rear section of the chute 35 are gravity fed through the passage inlet into the passage.

A gate shaft 47 extends between and is journaled in the sides 40. A normally closed gate 48 is carried by the shaft 47. A gate spring 49 is around the shaft 47. The spring acts against the gate 48 to bias the gate closed such that the gate normally blocks the passage outlet 45 to retain products in the chute 35.

A pair of upstanding cam arms 50 are mounted on either side of the chute at a location near the load station 18. A cam rod 52 is removably secured between the arms 50. A gate cam 54 is connected to the gate 48. When the cylinder 34 is actuated to move the chute toward an open bag 20 in the load station, the gate cam 54 strikes a cam follower 56 mounted on the cam rod 52 to open the gate 48 against the spring bias and allow products in the chute to flow into the bag. The cam follower 56 is adjustable along the cam rod 52 to accommodate chutes of a range of sizes. Alternatively and preferably, a number of cam followers 56 are mounted on the rod 52. The number of followers will equal the number of chutes to be used with each follower appropriately positioned to open the gate of an associated one of the chutes. When multiple cam followers are used no adjustments of the cam followers are needed after a first set up.

A pair of dashpots 58 are mounted on the base 26. A pair of dashpot engaging arms 60 are fixed to the rods 28. When the rods are advanced by actuation of the cylinder 34, forward motion of the chute 35 is arrested relatively abruptly by the coaction of the dashpots and arms 58,60.

OPERATION

An operator first selects an appropriate bag supply 16 having a web of bags 15 sized appropriately for products to be packaged. The web 15 is fed through the bagger 12 and the bagger is set up in the manner described more completely in the referenced Excel Patent. The bagger is rotated to orient the bagger and the bag support 22 at an appropriate angular orientation relative to the vertical. A chute 35 of a size appropriate for products to be packaged is selected and mounted on the chute support 28. A set of products to be packaged are manually deposited in the load area 46 and allowed to slide downwardly to the outlet 45 and against the gate 48 blocking the outlet. When a bag 20 is appropriately positioned in the load station and opened, the cylinder 34 is energized to advance the chute toward the bag. This energization of the cylinder is preferably in response to a signal from a system control 62, FIG. 1 after it has received a signal from an eye 63 indicating a product is present and ready for loading.

Figure 2:
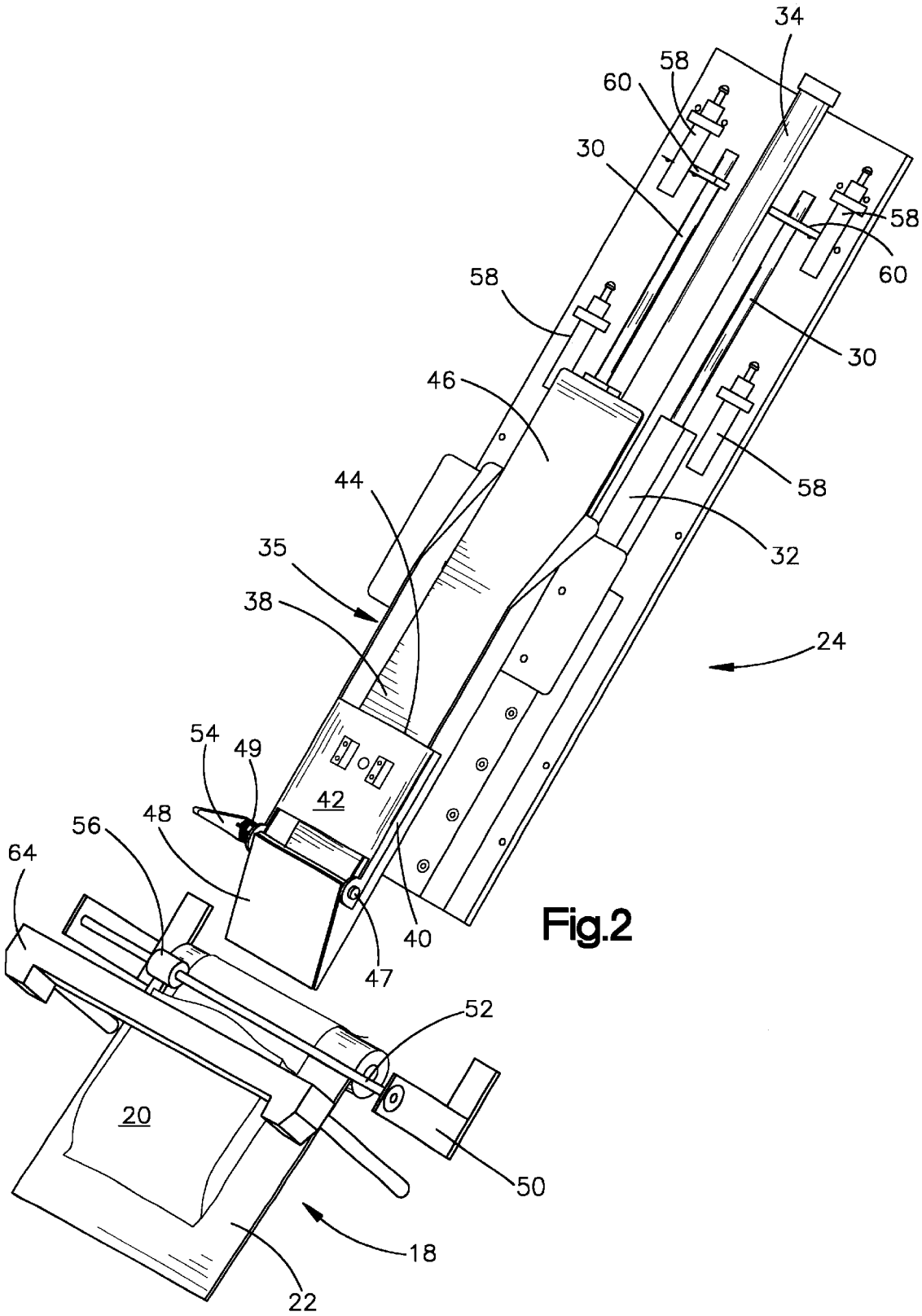
FIG. 2 is a perspective view of the load assisting assembly of the present invention; and, FIGS. 3 and 4 are respectively side elevational and plan views of the load assisting assembly on a reduced scale with respect to FIG. 2 and an enlarged scale with respect to FIG. 1.
Figure 3:
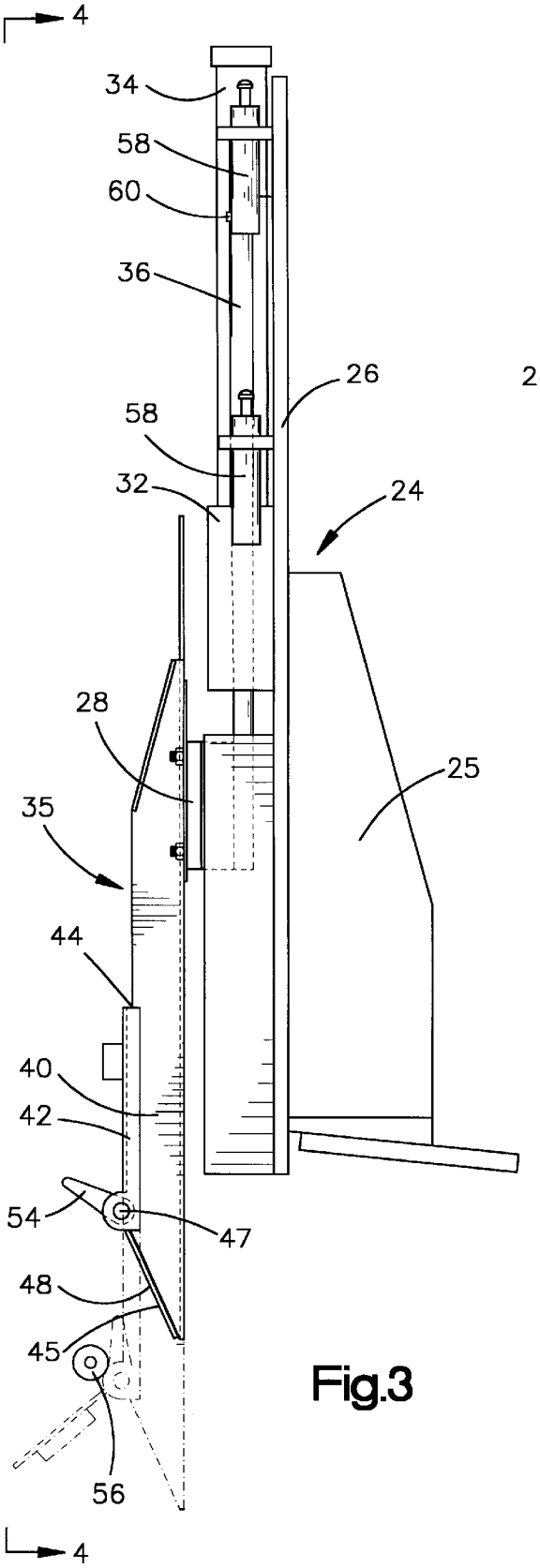
Figure 4:
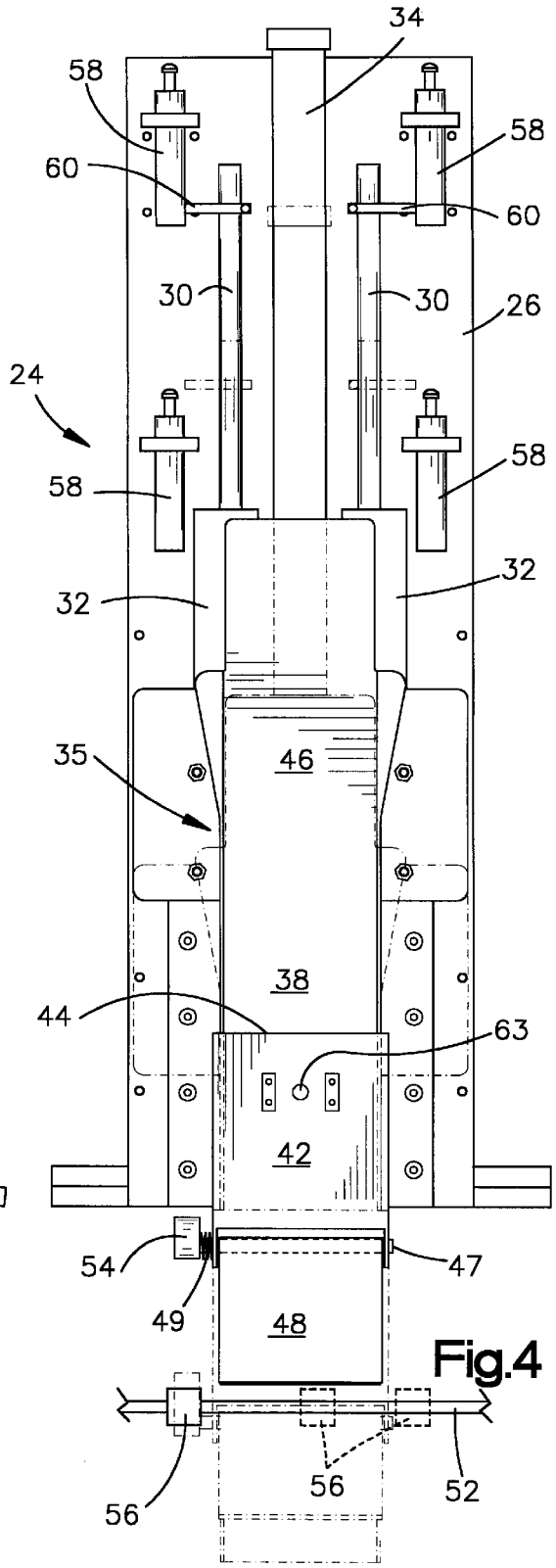

As the chute is advanced, the cam 54 engages an aligned one of the cam followers 56 to move the gate from its closed position, as shown in FIG. 1, to the open position of FIGS. 2 and 3. The dashpot arms 60 engage the dashpots 58 bringing the chute movement to a relatively abrupt halt, while the combination of gravity pull and inertia of motion cause products positioned in the chute 35 to flow quickly from the chute into the bag 20. Once the products are in their bag, a sealer 64 is actuated to close on the bag and affect a heat seal of it to complete the package. Concurrently the cylinder 34 is actuated to return the chute 35 to its load position. As the chute is returned, the gate spring 49 closes the gate 48. The operator now deposits the next set of products to be packaged into the chute 35. Concurrently, the bagger 25 is completing its cycle by separating the loaded bag 20 from the web 15 as the seal is being effected, releasing the sealed bag now a package from the load station and advancing and opening the next and now end bag of the web-into the load station.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A packaging system comprising:

a) a bagger for delivering a web of preopened bags from a supply to a load station, the bagger being adapted sequentially to register and open bags at the load station; and, b) a bag loading assembly carried by the bagger;

c) the assembly including:

I) a base;

ii) a tubular load chute reciprocatably mounted on the base, the chute delineating a product receiving passage extending from a load opening at one end of the passage to a discharge opening at the other end;

iii) a gate normally in a closed position blocking the discharge opening and openable when the discharge opening is registered with an open bag at the load station to discharge at least one product into such open bag; and, d) one of the bagger and the load chute being adjustably mounted whereby the chute adapted to be positioned for gravity discharge of products through the discharge opening.

2. The system of claim 1, wherein the assembly includes a fluid cylinder operably interposed between the base and the chute for reciprocating the chute between a product receiving position and a product discharge position.

3. The system of claim 1, wherein the assembly includes a spring biasing the gate toward its closed position.

4. The system of claim 1, wherein the chute includes a product receiving trough upstream from the passage.

5. A packaging system comprising:

a) a stand;

b) a bagger rotatably mounted on the stand for delivering a web of preopened bags from a supply to a load station, the bagger being adapted sequentially to register and open bags at the load station; and, c) a bag loading assembly carried by the bagger;

d) the assembly including:

I) a base;

ii) a tubular load chute reciprocatably mounted on the base, the chute delineating a product receiving passage extending from a load opening at one end of the passage to a discharge opening at the other end; and, iii) a gate normally in a closed position blocking the discharge opening and openable when the discharge opening is registered with an open bag at the load station to discharge at least one product into such open bag; and, e) the bagger including a support at the load station for supporting open bags at an angle with an imaginary vertical line.

6. A packaging system comprising:

a) a bagger for delivering a web of preopened bags from a supply to a load station, the bagger being adapted sequentially to register and open bags at the load station; and, b) a bag loading assembly carried by the bagger;

c) the assembly including:

I) a base;

ii) a tubular load chute reciprocatably mounted on the base, the chute delineating a product receiving passage extending from a load opening at one end of the passage to a discharge opening at the other end;

iii) a gate normally in a closed position blocking the discharge opening and openable when the discharge opening is registered with an open bag at the load station to discharge at least one product into such open bag; and, iv) a cam arrangement operable to open the gate.

7. The system of claim 6, wherein the arrangement includes a counterweight biasing the gate toward its closed position.

* * * * *